US008997905B2

(12) United States Patent
Johnson et al.

(10) Patent No.: US 8,997,905 B2
(45) Date of Patent: Apr. 7, 2015

(54) ELECTRIC UTILITY VEHICLE

(75) Inventors: Daniel T. Johnson, Medina, MN (US); Andrew L. Dvorak, Minnetonka, MN (US)

(73) Assignee: Dane Technologies, Inc., Brooklyn Park, MN (US)

( * ) Notice: Subject to any disclaimer, the term of this patent is extended or adjusted under 35 U.S.C. 154(b) by 79 days.

(21) Appl. No.: 13/538,763

(22) Filed: Jun. 29, 2012

(65) Prior Publication Data

US 2013/0098698 A1 Apr. 25, 2013

Related U.S. Application Data

(60) Provisional application No. 61/502,771, filed on Jun. 29, 2011.

(51) Int. Cl.
*B60K 1/00* (2006.01)
*E01H 1/08* (2006.01)
(Continued)

(52) U.S. Cl.
CPC ..... *A47L 11/4066* (2013.01); *A47L 11/10* (2013.01); *A47L 11/20* (2013.01); *A47L 11/24* (2013.01); *A47L 11/4055* (2013.01); *A47L 11/4058* (2013.01); *A47L 11/4094* (2013.01)

(58) Field of Classification Search
CPC ..... B60R 2021/0081; B60R 2021/0073; E01H 1/00; E01H 1/02; E01H 1/04; E01H 1/05; E01H 1/053; E01H 1/056; E01H 1/0836; E01H 1/0827; A47L 11/00; A47L 11/10; A47L 11/12; A47L 11/14; A47L 11/16; A47L 11/18; A47L 11/19; A47L 11/20; A47L 11/4052; A47L 11/4055; A47L 11/4058; A47L 11/4069; A47L 11/4038; B24B 7/18; B24B 7/182; B24B 7/186
USPC ..... 180/65.1, 6.2, 315, 324, 331, 21, 210, 180/211; 451/350–353; 15/340.1, 340.3, 15/340.4, 49.1, 50.1, 78, 98
See application file for complete search history.

(56) References Cited

U.S. PATENT DOCUMENTS 2,268,519 A * 12/1941 Teager ..... 15/78
2,972,159 A * 2/1961 Kimmerle et al. ..... 15/340.4
(Continued)

FOREIGN PATENT DOCUMENTS

DE 4124682 A1 1/1993
DE 4128988 A1 3/1993
(Continued)

OTHER PUBLICATIONS

"International Application Serial No. PCT/US2012/045008, International Search Report mailed Jun. 12, 2013", 6 pgs.
(Continued)

*Primary Examiner* — J. Allen Shriver, II
*Assistant Examiner* — James M Dolak
(74) *Attorney, Agent, or Firm* — Schwegman Lundberg & Woessner, P.A.

(57) ABSTRACT

A utility vehicle can comprise a wheeled platform, a motor coupled to the platform and configured to propel the platform, at least one cleaning element coupled to the platform, wherein the at least one cleaning element is movable between a collapsed position and an expanded position, and one or more controls configured to move the at least one cleaning element between the collapsed position and the expanded position. The at least one cleaning element can also be movable between a raised position and a lowered position relative to the wheeled platform, and the one or more controls can further be configured to move the at least one cleaning element between the raised position and the lowered position.

12 Claims, 18 Drawing Sheets

(51) Int. Cl.

| | |
|---|---|
| ***A47L 11/40*** | (2006.01) |
| ***A47L 11/10*** | (2006.01) |
| ***A47L 11/20*** | (2006.01) |
| ***A47L 11/24*** | (2006.01) |

(56) References Cited

U.S. PATENT DOCUMENTS

| | | | | |
|---|---|---|---|---|
| 3,604,051 | A * | 9/1971 | Wendel et al. | 15/340.4 |
| 4,580,312 | A * | 4/1986 | Van Raaij | 15/339 |
| 4,754,521 | A * | 7/1988 | Zoni | 15/340.1 |
| 4,989,288 | A * | 2/1991 | Moore | 15/98 |
| 5,033,564 | A * | 7/1991 | Mattson | 180/305 |
| 5,455,985 | A * | 10/1995 | Hamline et al. | 15/401 |
| 5,687,443 | A * | 11/1997 | Moore | 180/210 |
| 6,295,682 | B1 * | 10/2001 | Klucznik | 15/50.1 |
| 6,419,565 | B2 * | 7/2002 | Mattson et al. | 180/19.3 |
| 6,516,488 | B1 * | 2/2003 | Cados | 15/52.2 |
| 6,964,081 | B1 * | 11/2005 | Clement et al. | 15/320 |
| 6,986,397 | B2 * | 1/2006 | Mattson et al. | 180/11 |
| 7,313,838 | B2 * | 1/2008 | Long et al. | 15/22.2 |
| 7,313,839 | B2 * | 1/2008 | Shinler | 15/49.1 |
| 7,533,435 | B2 * | 5/2009 | Pedlar et al. | 15/49.1 |
| 8,091,672 | B2 * | 1/2012 | Gutsch et al. | 180/218 |
| 8,678,883 | B2 * | 3/2014 | Strickland | 451/350 |
| 8,714,291 | B2 * | 5/2014 | Riach | 180/68.5 |
| 8,769,755 | B2 * | 7/2014 | Hetler | 15/49.1 |
| 8,839,479 | B2 * | 9/2014 | Hruby | 15/98 |
| 2005/0102778 | A1 * | 5/2005 | Gregerson | 15/82 |
| 2007/0068452 | A1 | 3/2007 | Raddick | |

FOREIGN PATENT DOCUMENTS

| | | | |
|---|---|---|---|
| DE | 4042574 | C2 | 10/1997 |
| WO | WO-2006121783 | A1 | 11/2006 |
| WO | WO-2010077959 | A1 | 7/2010 |
| WO | WO-2013003755 | A2 | 1/2013 |
| WO | WO-2013003755 | A3 | 1/2013 |

OTHER PUBLICATIONS

"International Application Serial No. PCT/US2012/045008, Invitation to Pay Additional Fees and Partial Search Report mailed Jan. 28, 2013", 5 pgs.

"International Application Serial No. PCT/US2012/045008, Written Opinion mailed Jun. 12, 2013", 9 pgs.

"International Application Serial No. PCT/US2012/045008, International Preliminary Report on Patentability mailed Jan. 16, 2014", 11 pgs.

* cited by examiner

ELECTRIC UTILITY VEHICLE

CROSS-REFERENCE TO RELATED APPLICATIONS

This patent application claims the benefit of priority, under 35 U.S.C. §119(e), to U.S. Provisional Patent Application Ser. No. 61/502,771, entitled "QUICKLEEN ELECTRIC UTILITY MACHINE," filed on Jun. 29, 2011, which is herein incorporated by reference in its entirety.

BACKGROUND

The use of cleaning elements, such as a mop, a broom, or a vacuum, for janitorial services is well known. For a large facility, such as a large shopping center, an airport, a factory, a distribution center, or a school, large cleaning elements are often used to allow for cleaning of relatively large surface areas. The mops or brooms typically must be manually pushed by a janitor or other cleaning personnel. Vacuum assemblies can be motor-driven, but are typically operated by a user pushing or walking behind the vacuum assembly. Moreover, the cleaning element or elements must be transported, usually manually transported, from a storage location to a location that needs to be cleaned.

SUMMARY

This disclosure describes a multi-purpose, multi-mode utility vehicle that can be used to rapidly transport one or more cleaning elements, such as mops, dry mops, brooms, and vacuum assemblies, and to deploy and use the one or more cleaning elements. The platform can also be configured to carry or tow a second platform, such as a janitorial cart, which can carry other components that can be useful for cleaning or other janitorial work. For example, the janitorial cart can carry at least one of a mop bucket, a trash receptacle, a paper-products receptacle, and a cleaning-supply receptacle. The utility vehicle can allow a user to dry mop, broom, or vacuum large areas; collect trash, distribute cleaning supplies; or carry a mop and bucket. Numerous other capabilities can also be incorporated into or can be made compatible with the utility vehicle.

In an example, a utility vehicle comprises a platform, a motor coupled to the platform and configured to propel the platform, at least one cleaning element coupled to the platform, wherein the at least one cleaning element is movable between a collapsed position and an expanded position, and one or more controls configured to move the at least one cleaning element between the collapsed position and the expanded position.

In an example, an electric utility vehicle comprises a wheeled platform, a seat coupled to the platform for carrying a user, an electric motor coupled to the platform and configured to propel the platform, a pair of cleaning elements coupled to the platform, wherein the pair of cleaning elements are movable between a raised position and a lowered position, wherein the pair of cleaning elements are movable between a collapsed position and an expanded position with respect to each other, a first control configured to move the pair of cleaning elements between the raised position and the lowered position, and a second control configured to move the pair of cleaning elements between the collapsed position and the expanded position.

In an example, a system comprises a utility vehicle including a platform and a motor to propel the platform, a first assembly of a first set of one or more cleaning elements configured to be coupled at a first location of the wheeled platform, a second assembly of a second set of one or more cleaning elements configured to be coupled at the first location of the wheeled platform, and a first mechanism configured to move one or more cleaning elements coupled to the wheeled platform between a collapsed position and an expanded position.

These and other examples and features of the present systems and methods will be set forth in part in the following Detailed Description. This Summary is intended to provide an overview of the present subject matter, and is not intended to provide an exclusive or exhaustive explanation. The Detailed Description below is included to provide further information about the present systems and methods.

BRIEF DESCRIPTION OF THE DRAWINGS

In the drawings, like numerals can be used to describe similar elements throughout the several views. Like numerals having different letter suffixes can be used to represent different views of similar elements. The drawings illustrate generally, by way of example, but not by way of limitation, various embodiments discussed in the present document.

DETAILED DESCRIPTION OF THE INVENTION

Figure 1:
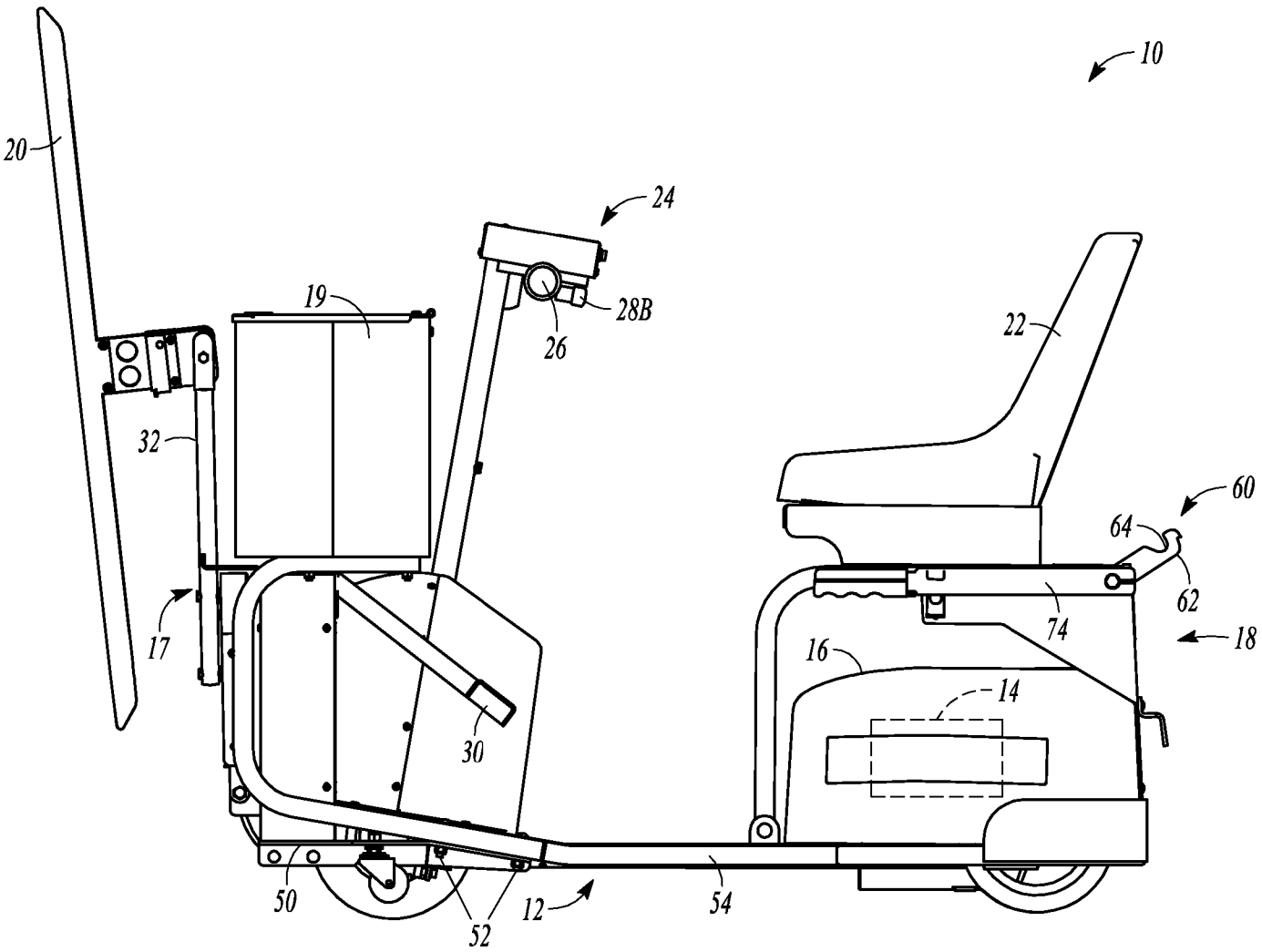
FIG. 1 is a side view of an example electric utility vehicle.

An electric utility vehicle is disclosed, and, more particularly, an electric utility vehicle having one or more deployable cleaning elements, such as one or more mops, one or more brooms, or one or more vacuum assemblies, coupled to the electric utility vehicle. The one or more cleaning elements can be detachably coupled to a wheeled platform of the electric utility vehicle, such as on a front end of the vehicle, so that one or more first cleaning elements can be removed and replaced with one or more second cleaning elements. For example, a set of dry mops can initially be coupled to the electric utility vehicle, which can then be removed and a set of brooms or a vacuum assembly can be coupled to the electric utility vehicle. Similarly, a replacement set of dry mops, brooms, a vacuum assembly, or other cleaning elements can be easily installed onto the electric utility vehicle.

The one or more cleaning elements can be easily deployable by a user of the electric utility vehicle. For example, the one or more cleaning elements can be movable between a raised position, e.g., an undeployed position, and a lowered position, e.g., a deployed position. When in the raised position, the electric utility vehicle can be moved to a location to be cleaned, where the one or more cleaning elements can be deployed into the lowered position to allow for cleaning of the location. One or more controls can be included on the electric utility vehicle that can effectuate deploying the cleaning elements from the raised position to the lowered position, and vice versa.

The one or more cleaning elements can also be adjustable so that an effective width of the one or more cleaning elements can be changed depending on the circumstances of use or the environment that the electric utility vehicle is in. In an example, the one or more cleaning elements can be moved between a collapsed position and an expanded position. When in the collapsed position, the effective width of the one or more cleaning elements can be narrow enough for the one or more cleaning elements to fit through tight spaces, such as through a doorway or a narrow passageway. When in the expanded position, the effective width of the one or more cleaning elements can be selected to maximize the electric utility vehicle's effective cleaning area. The adjustability of the effective width of the one or more cleaning elements can also allow a user to more easily maneuver around obstacles when cleaning. One or more controls can be included on the electric utility vehicle that can effectuate moving the one or more cleaning elements between the collapsed position and the expanded position.

The electric utility vehicle can also be configured to receive or be coupled to one or more additional components, such as a janitorial cart coupled to a back end of the electric utility vehicle. The janitorial cart can be carried by the electric utility vehicle or towed behind the electric utility vehicle. In an example, the janitorial cart can be configured to carry other cleaning implements that can be useful to a user, such as a mop and mop bucket, a trash receptacle, paper products, or cleaning supplies. The cart can be releasably coupled to the electric utility vehicle so that the cart can be used independently of the machine.

The electric utility vehicle can be configured to be ridden by a user, such as with a seat, so that the user and the electric utility vehicle can be rapidly deployed to a cleaning location. Thus, the electric utility vehicle can improve efficiency by enabling a user to safely and quickly travel a significant distance, while also carrying one or more cleaning elements, and if desired other supplies. The speed of using the electric utility vehicle can help the user to more efficiently maintain the appearance of a site and can reduce the risk of a customer or team member slip-and-fall event. In addition, the electric utility vehicle can make scheduled cleaning more productive. Furthermore, a user can carry out several tasks at the same time, allowing the user to complete a series of tasks with increased efficiency.

Figure 2:
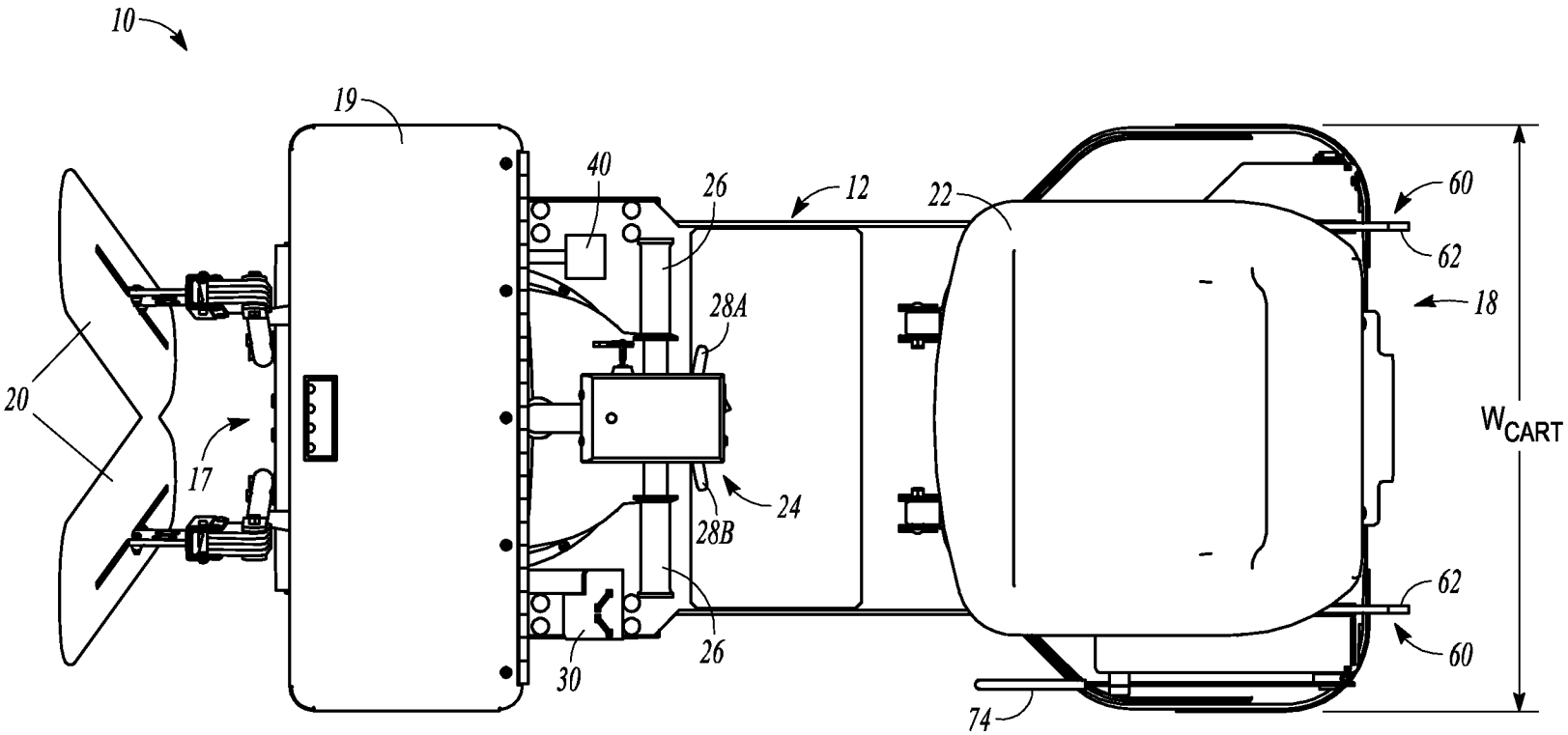
FIG. 2 is a top view of the example electric utility vehicle.
Figure 3:
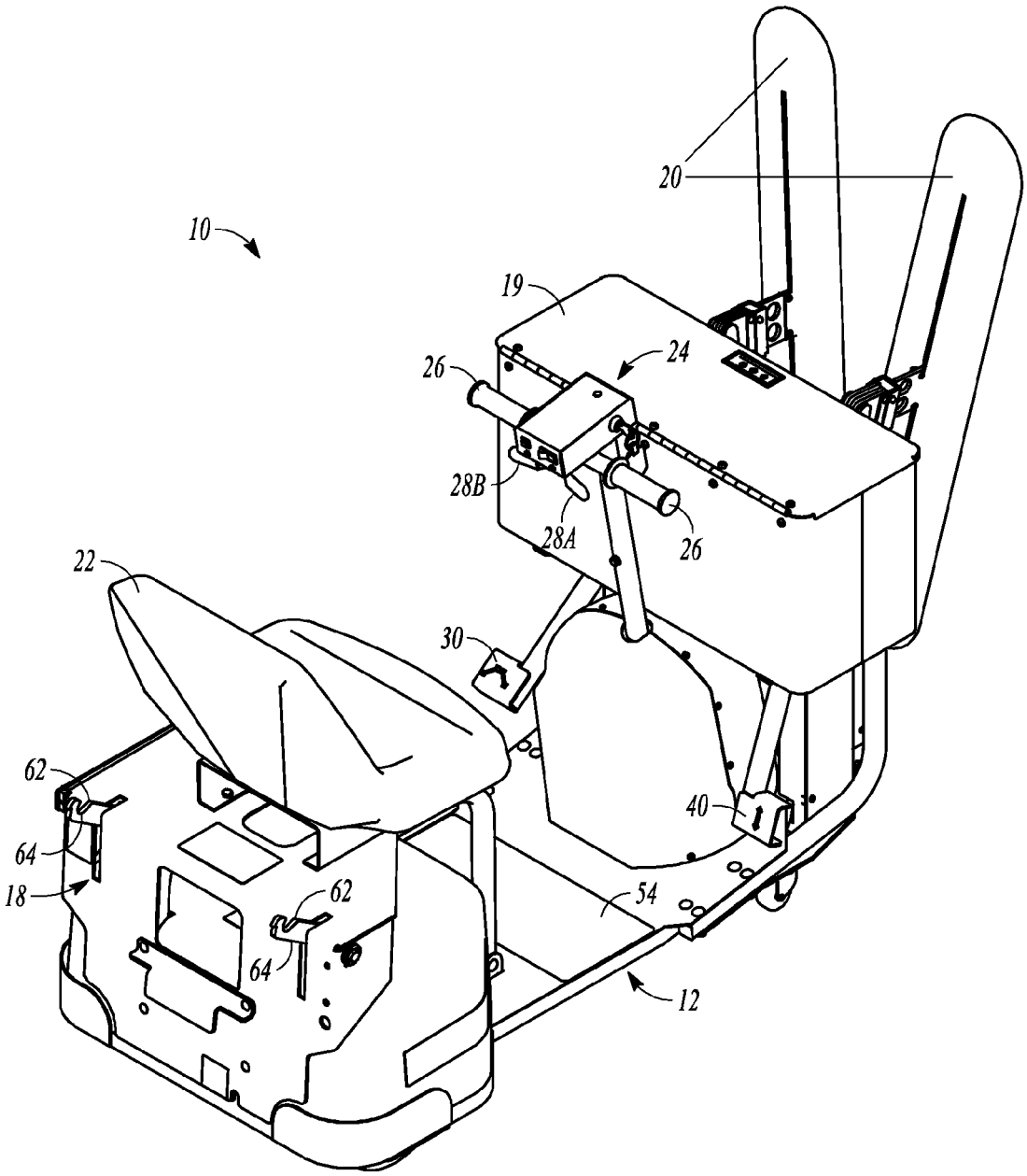
FIG. 3 is an isometric perspective view of the example electric utility vehicle.

FIGS. 1-3 show several views of an example utility vehicle 10. The utility vehicle 10 can include a platform 12 which can take any form that can be useful for a user, such as a motorized cart as shown in FIGS. 1-3. The platform 12 can be a wheeled platform 12 comprising wheels that facilitate movement of the platform 12, as shown in FIGS. 1-3. Structures other than wheels can be used to facilitate movement of the platform 12, such as tracks or belts and the like. A motor 14 can be coupled to the platform 12, such as within a housing 16 of the wheeled platform 12. In an example, the motor 14 can comprise an electric motor that can powered by electricity, e.g., from battery power or DC power. For the sake of simplicity, the remainder of this disclosure will refer to the utility vehicle 10 as an electric utility vehicle 10. However, a person of ordinary skill in the art will appreciate that the utility vehicle 10 is not limited to electric power. Other suitable sources of power can include gasoline, propane, and the like.

The electric utility vehicle 10 can include one or more features that allow a user to clean an area. For example, a trash bin 19 can be coupled to the platform 12, such as to a front end 17 of the platform 12, as shown in FIGS. 1-3, or to a back end 18. One or more cleaning elements 20 can be coupled to the platform 12, such as to the front end 17 or to the back end 18. Each cleaning element 20 can comprise a wet mop, a dry mop, a broom, a vacuum assembly, or any other structure that can be used to clean a surface, such as a floor, the ground, a sidewalk, a parking lot surface, and the like. As described in more detail below, the one or more cleaning elements 20 can be movable, such as between a collapsed position and an expanded position or between a non-deployed or raised position and a deployed or lowered position. The movability of the cleaning elements 20 can provide for easier maneuverability of the electric utility vehicle 10 when the cleaning elements 20 are not being used to clean, or when cleaning an area with one or more obstacles that can need to be negotiated. The electric utility vehicle 10 can include one or more controls for moving the cleaning elements 20. One or more of the controls can also be configured for moving the platform 12, such as to control the motor 14.

In the examples shown in FIGS. 1-3, the wheeled platform 12 of the electric utility vehicle 10 can be configured as a cart that can be ridden by a user. For the sake of brevity and simplicity, the wheeled platform 12 will be referred to herein as a cart 12 or a wheeled cart 12. However, the wheeled platform 12 is not limited to a cart configuration. As shown in the examples of FIGS. 1-3, the cart 12 can include a seat 22 configured for carrying a user while the electric utility vehicle 10 moves along the ground.

If the electric utility vehicle 10 includes controls, such as to control the motor 14 or to control the cleaning elements 20, the controls can be accessible by a user when sitting on the seat 22, such as by being reachable and controllable by the user's hands or feet. The electric utility vehicle 10 can include one or more motor controls 24 that can be manipulated by a user, such as a user sitting on the seat 22. The motor controls 24 can be positioned to be substantially directly in front of the user while sitting on the seat 22 so that the user can operate the motor controls 24 with his or her hands. In an example, the motor controls 24 can include one or more handles 26 that can be grasped by a user to steer the electric utility vehicle 10, such as by controlling a steering mechanism that turns one or more wheels of the wheeled cart 12. The motor controls 24 can also include one or more directional controls 28A, 28B, such as a first lever 28A that can cause the motor 14 to move the electric utility vehicle 10 in a forward direction and a second lever 28B that can cause the motor 14 to move the electric utility vehicle 10 in a rearward direction.

Figure 4A:
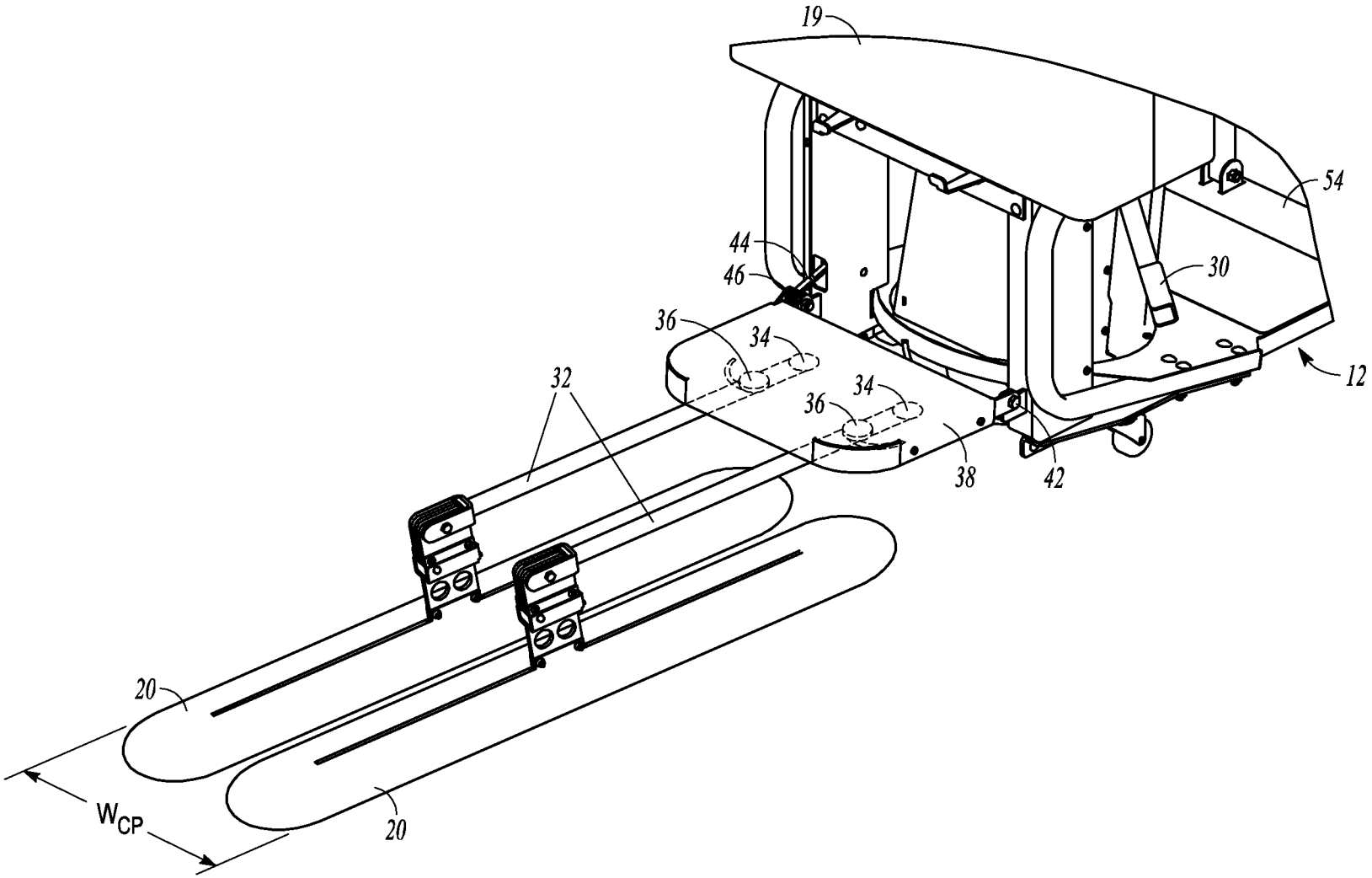
FIGS. 4A and 4B are front perspective views of example cleaning elements, such as dry mops, in a closed or retracted position and in an open or expanded position, respectively.
Figure 4B:
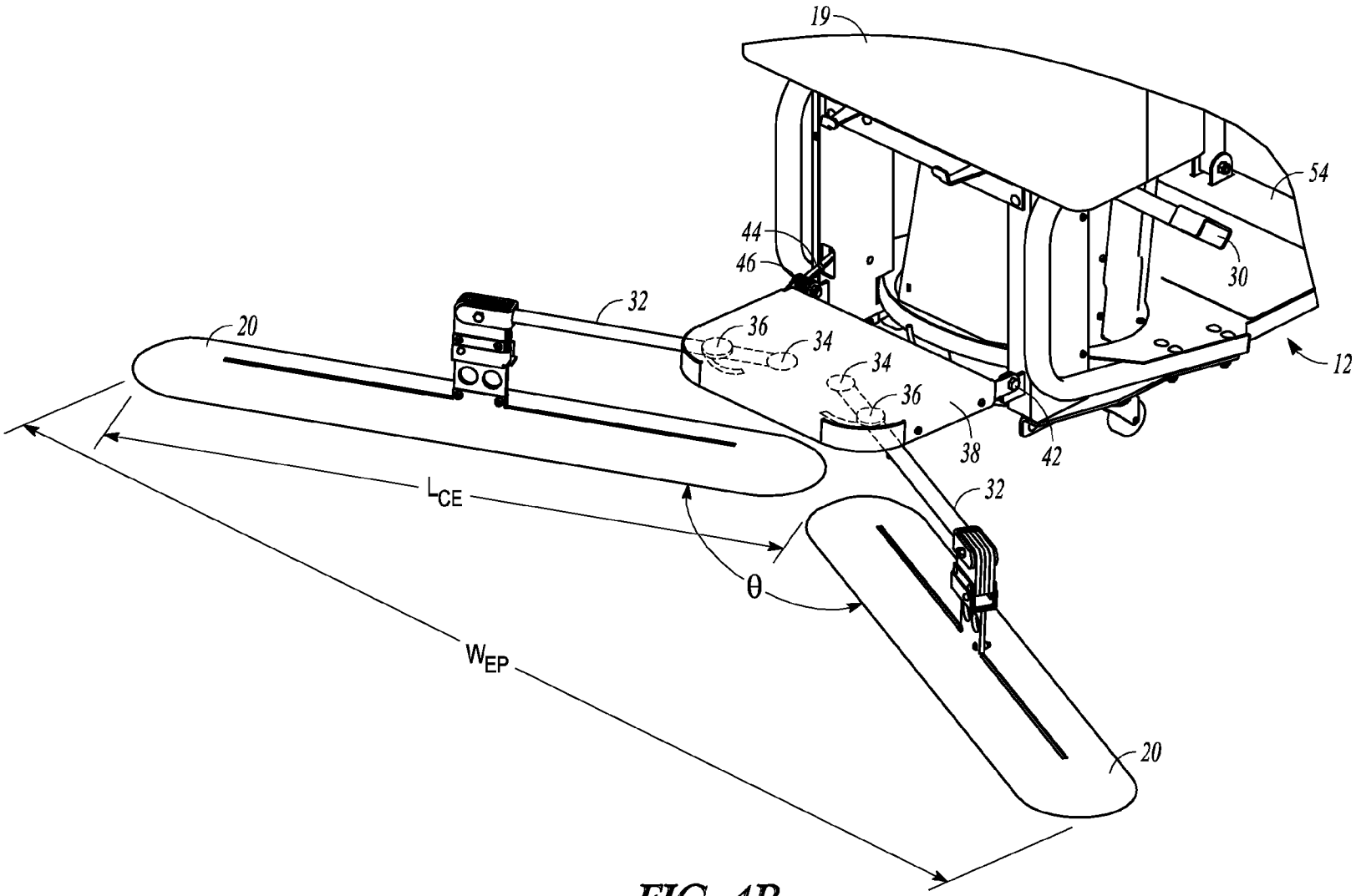
Figure 5A:
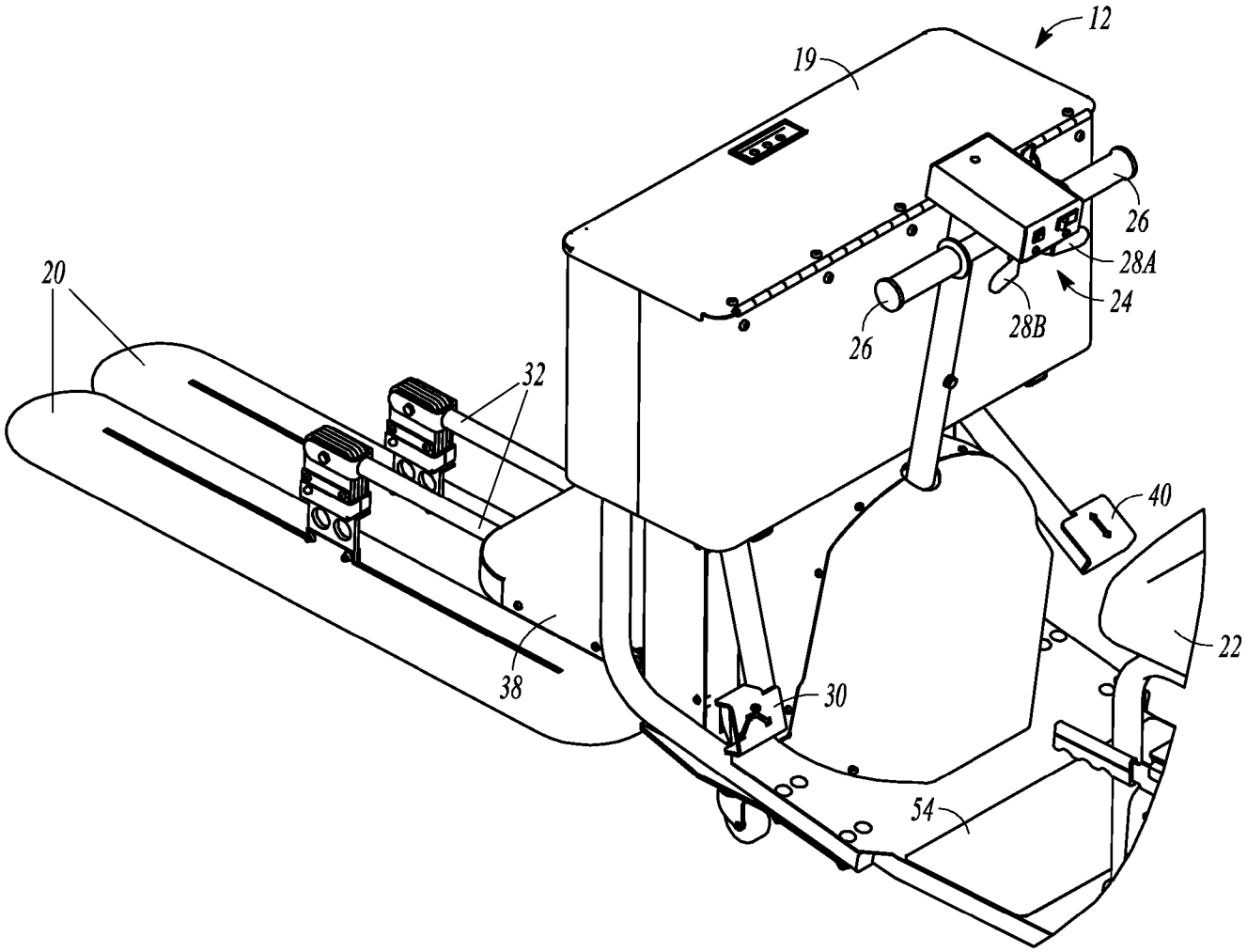
FIGS. 5A and 5B are side perspective views of the example cleaning elements in the retracted position and the expanded position, respectively, and a control, such as a pedal, that can move the cleaning elements between the retracted position and the expanded position.
Figure 5B:
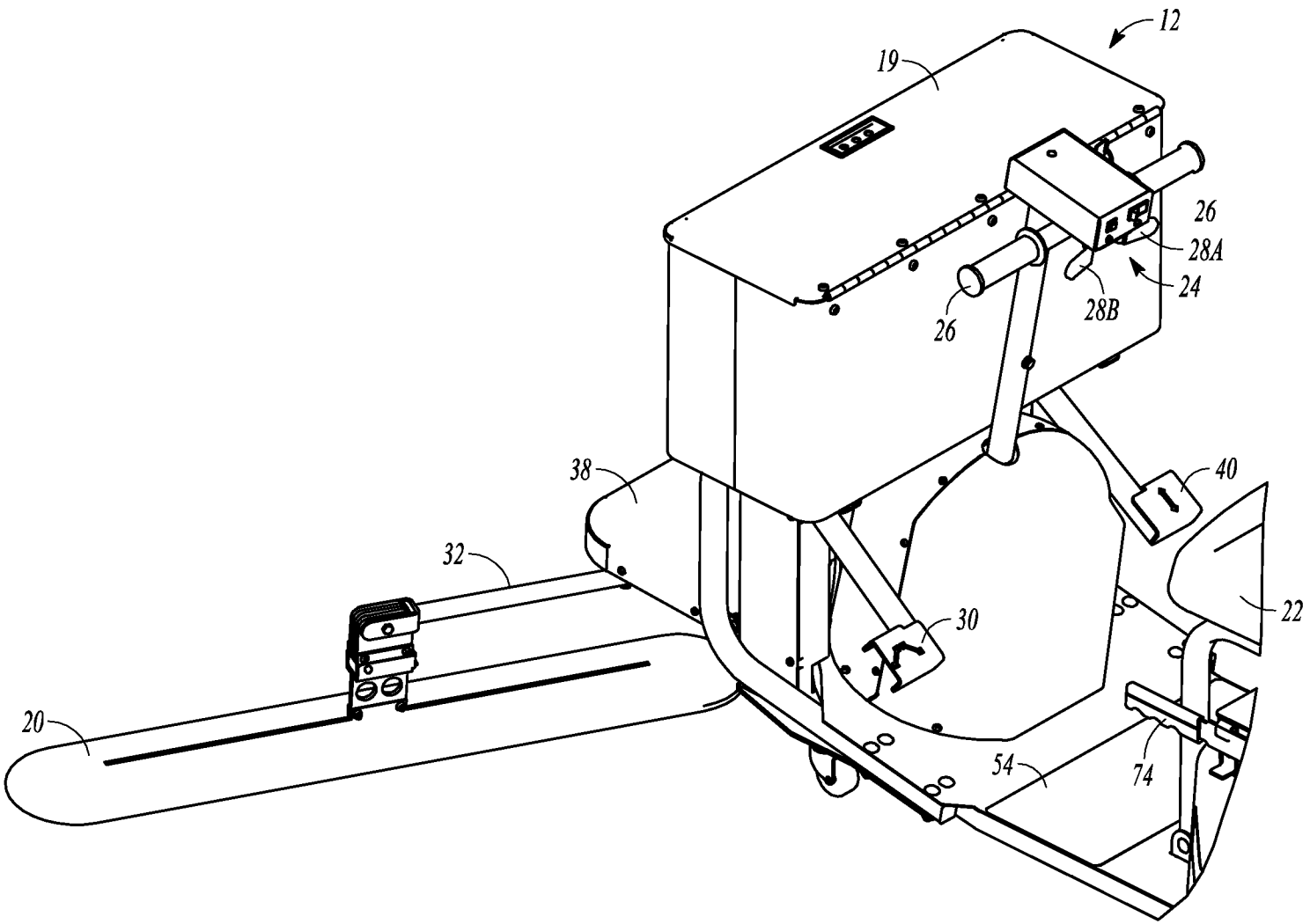

As described above, the one or more cleaning elements 20 can be movable to provide for maneuverability of the electric utility vehicle 10, such as when cleaning an area that includes obstacles or a narrow profile. FIGS. 4A, 4B, 5A, and 5B show front perspective views (FIGS. 4A and 4B) and side perspective views (FIGS. 5A and 5B) of a pair of cleaning elements 20, in this case dry mops, being moved between a closed or collapsed position (FIGS. 4A and 5A) and an open or expanded position (FIGS. 4B and 5B). In the example shown in the figures, each of a pair of cleaning elements 20 are arranged in a substantially parallel, side-by-side arrangement when in the collapsed position, and are opened outwardly to define an angle θ relative to each other when in the expanded position. The angle θ can be an acute angle or an obtuse angle.

The collapsed position can allow the electric utility vehicle 10 to be more easily maneuvered such as through a narrow passageway or within a narrow space between obstacles. In an example as shown in FIG. 4A, the cleaning elements 20 can have a contracted-position lateral width $W_{CP}$ that is the same or narrower than a width $W_{Cart}$ of the cart 12 (FIG. 2) when in the collapsed position so that the cleaning elements 20 can fit into any space that is accessible by the cart 12. The cart width $W_{Cart}$ can be less than the width of a standard doorway so that the cart 12 and the cleaning elements 20 (when in the collapsed position) can fit through doorways. In an example, the cart width $W_{Cart}$ can be less than 48 inches (1.2 meters), less than 36 inches (0.91 meters), less than 32 inches (0.81 meters), less than 30 inches (0.76 meters), or less than 28 inches (0.71 meters).

The expanded position of the cleaning elements 20 can provide for a large cleaning width of the cleaning elements 20. As noted above, in an example, a pair cleaning elements 20 can be opened to an angle θ. In an example, angle θ can be between 0 degrees and 180 degrees, inclusive, for example between 45 degrees and 179 degrees, inclusive, such as between 90 degrees and 170 degrees, inclusive. In an example, the angle θ is an obtuse angle of between about 90 degrees and about 180 degrees, inclusive, for example between about 120 degrees and about 179 degrees, inclusive, such as between about 150 degrees and about 170 degrees, for example about 150 degrees, about 155 degrees, about 160 degrees, about 165 degrees, about 166 degrees, about 167 degrees, about 168 degrees, about 169 degrees, about 170 degrees, about 171 degrees, about 172 degrees, about 173 degrees, about 174 degrees, about 175 degrees, about 176 degrees, about 177 degrees, about 178 degrees, about 179 degrees, or about 180 degrees. As shown in FIG. 4B, each cleaning element 20 can have a length $L_{CE}$ that is selected for the area to be cleaned. In an example, the length $L_{CE}$ of each cleaning element 20 can be between about 24 inches (0.61 meters) and about 50 inches (1.2 meters). As further shown in FIG. 4B, when in the expanded position, the cleaning elements 20 can be configured to have a width $W_{EP}$ of between about 40 inches (1.2 meters) and about 100 inches (2.54 meters), such as about 48 inches (1.2 meters), about 50 inches (1.27 meters), about 55 inches (1.40 meters), about 60 inches (1.52 meters), about 66 inches (1.68 meters), about 70 inches (1.78 meters), about 72 inches (1.83 meters), about 75 inches (1.90 meters), about 78 inches (1.98 meters), about 80 inches (2.03 meters), about 84 inches (2.13 meters), or about 90 inches (2.29 meters).

The electric utility vehicle 10 can include one or more controls 30 that are operable to allow movement of the one or more cleaning elements 20 between the collapsed position and the expanded position, and vice versa. In the example, these one or more controls 30 can comprise a pedal 30 that can be actuated by user, such as with the foot of a user sitting on the seat 22. The pedal 30 can move between a first position associated with the collapsed position of the cleaning elements 20 (see, e.g., FIG. 4A), and a second position associated with the expanded position of the cleaning elements 20 (see, e.g., FIG. 4B). When a user moves the pedal 30 from the first position to the second position, such as by pulling on the pedal 30 or by pressing on the pedal 30 to engage a release and return mechanism that can move the pedal 30 to the second position, a mechanism can move the cleaning elements 20 from the collapsed position to the expanded position. When the user is ready to move the cleaning elements 20 back to the collapsed position, such as when he or she is done cleaning an area with the cleaning elements 20, the user can move the pedal 30 from the second position to the first position, such as by pressing down on the pedal 30 with the user's foot, to return the pedal 30 to the first position so that the mechanism can move the cleaning elements 20 to the collapsed position.

In an example, the mechanism that moves the cleaning elements 20 between the collapsed position and the expanded position can include one or more mechanical linkages between the pedal 30 and the cleaning elements 20. Each cleaning element 20 can be coupled to a leg 32, as described below. Each leg 32 can be pivotally coupled to the cart 12, such as at a pivot point 34, so that each leg 32 can pivot laterally outward and inward. For example, as shown in FIGS. 4A and 4B, the legs 32 can be coupled at pivot points 34 so that each leg 32 can pivot generally horizontally between the collapsed position and the expanded position. One or more mechanical linkages can connect the pedal 30 to a connection point 36 on each of the legs 32. As the pedal 30 is moved from the first position to the second position, the mechanical linkages can cause the connection points 36 to move laterally outward. The lateral outward movement of the connection points 36 and the pivotal coupling of the leg 32 at the pivot points 34 can cause the distal ends of the legs 32 to pivot outward and move the cleaning elements 20 from the collapsed position to the expanded position. Returning the pedal 30 to the first position can cause the mechanical linkages to move the connection points 36 laterally inwardly and pivot the distal ends of the legs 32 and the cleaning elements 20 from the expanded position to the collapsed position. In an example, shown in FIGS. 4A and 4B, the pivot points 34 and the connection points 36 can be included on a pivotable mounting plate 38 that is pivotably coupled to the cart 12. As described in more detail below, the mounting plate 38, and thus the cleaning elements coupled to the mounting plate 38, can be moved between a raised position and a lowered position.

In an example, the cleaning elements 20 can be manually movable between the collapsed position and the expanded position. For example, an electric utility vehicle could omit the pedal 30, and a user could manually adjust the cleaning elements 20 to the desired position.

Although FIGS. 4A, 4B, 5A, and 5B only show the cleaning elements 20 in two positions, e.g., a fully collapsed position and a fully expanded position, the cleaning elements 20 or the one or more controls 30 can be configured to move to more than one position. For example, the cleaning elements 20 can be configured to be movable between a fully collapsed position and a fully expanded position with one or more positions therebetween of varying degrees of collapse or expansion. In an example, the cleaning elements 20 or the one or more controls 30 can be configured to move to one or more discrete positions between the fully collapsed position and the fully expanded position, wherein each discrete position can correspond to a different width $W_{EP}$ of the cleaning elements 20 and a different angle θ between the cleaning elements 20. In another example, the cleaning elements 20 or the one or more controls 30 can be configured to continuously move between a fully-collapsed position and a fully-expanded position so that a user can select and fine tune the width $W_{EP}$ of the cleaning elements 20 while cleaning.

Figure 6A:
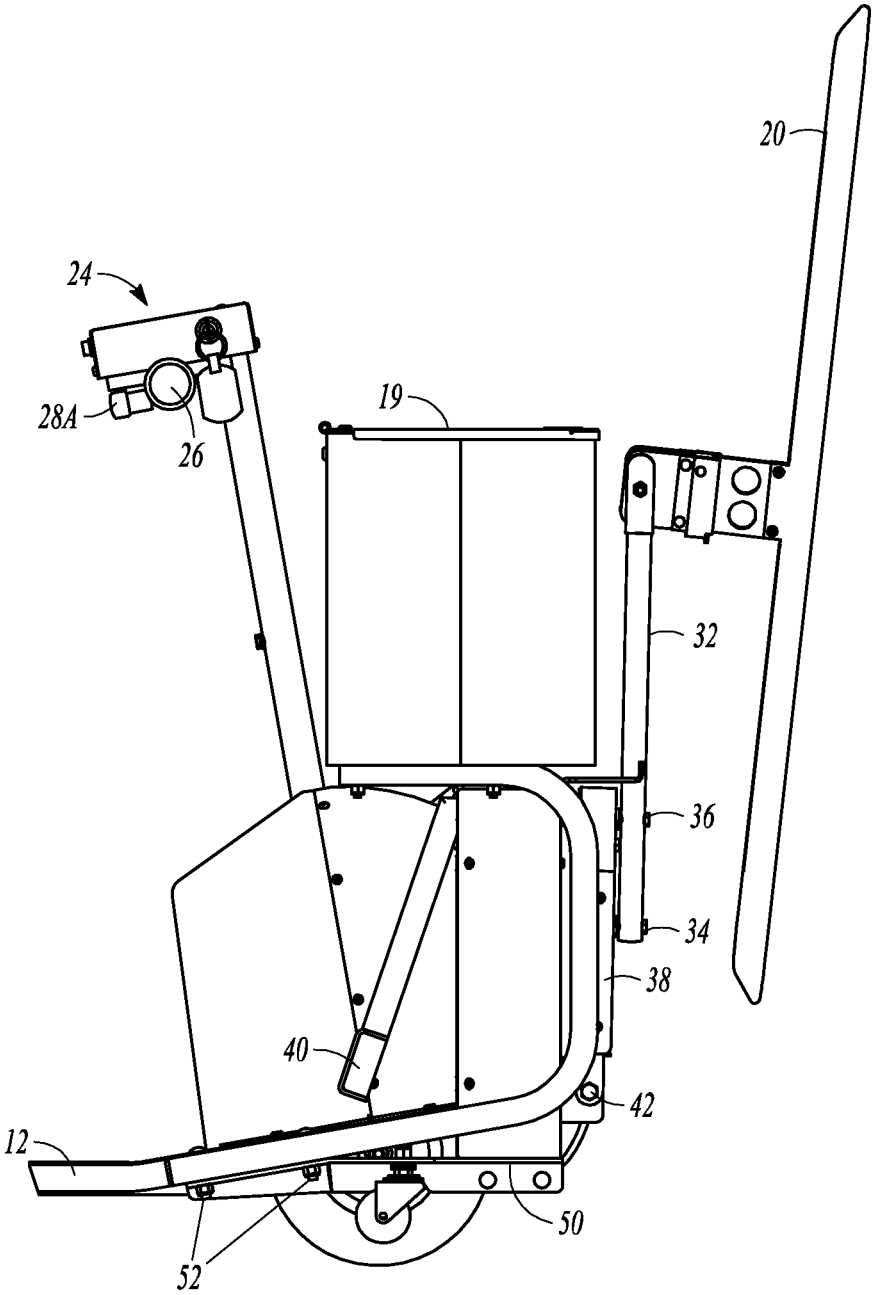
FIGS. 6A and 6B are side views of the cleaning elements in a raised position and a lowered position, respectively, and a control, such as a pedal, that can move the cleaning elements between the lowered position and the raised position.
Figure 6B:
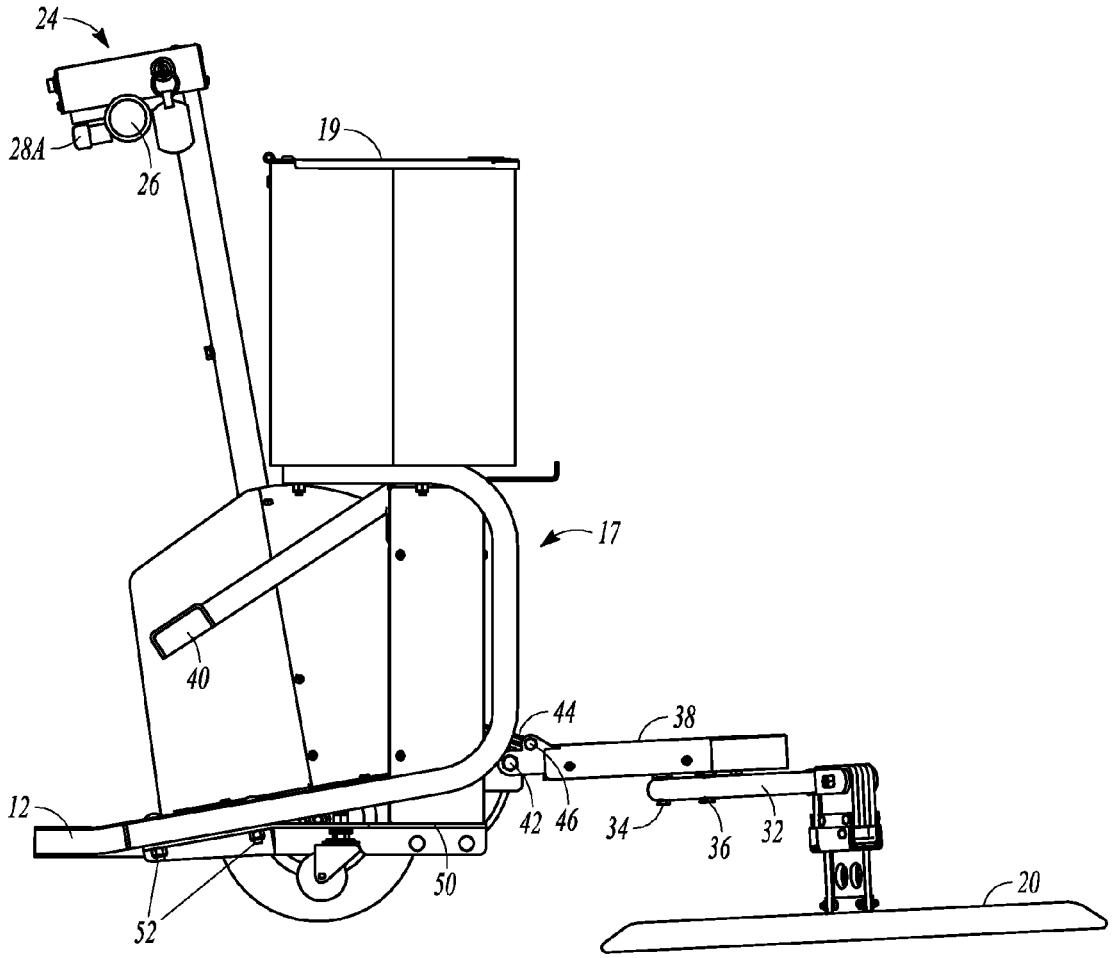
Figure 7A:
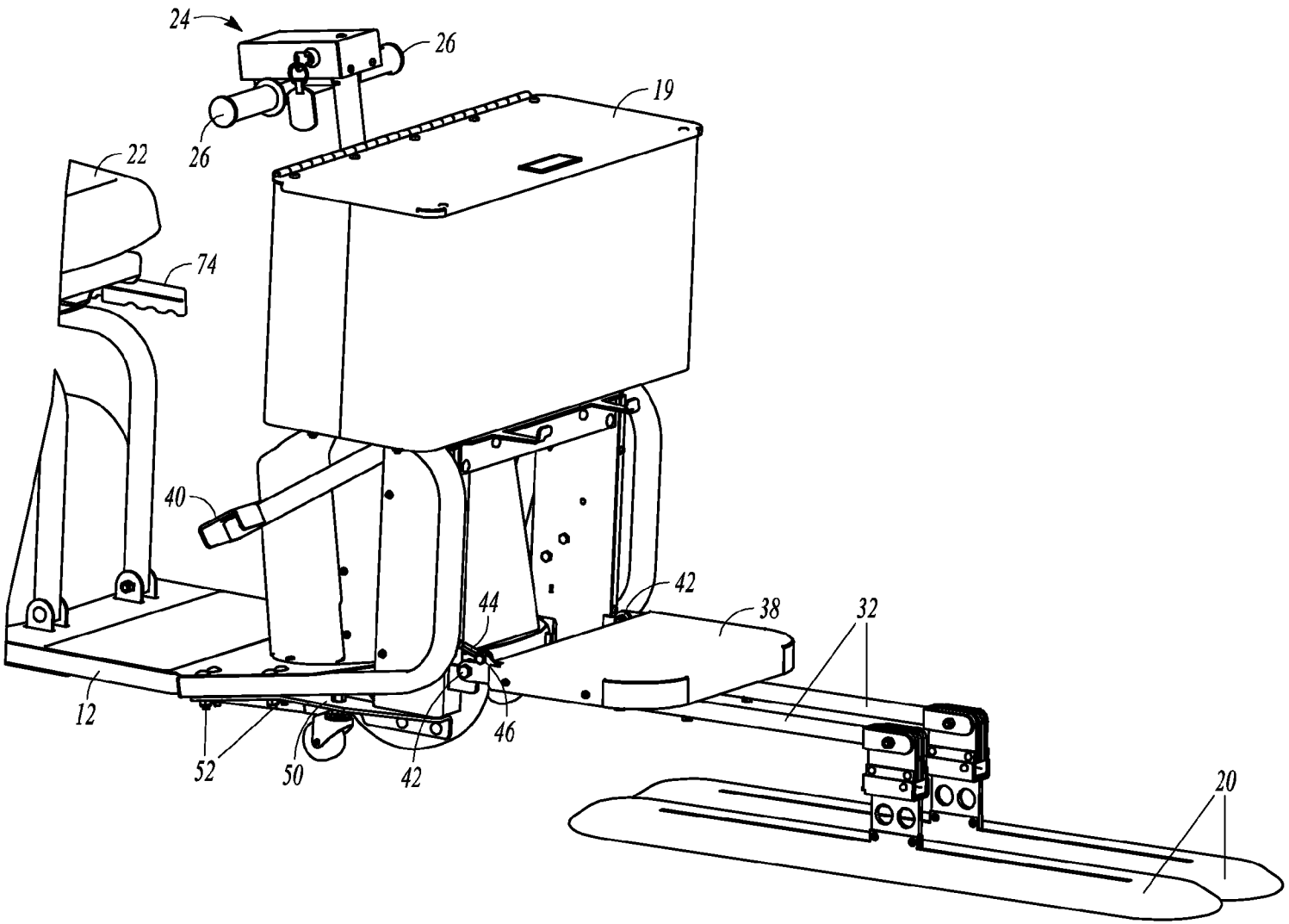
FIGS. 7A and 7B are front perspective views of the example cleaning elements in the raised position and the lowered position, respectively, and the example control that can move the cleaning elements between the lowered position and the raised position.
Figure 7B:
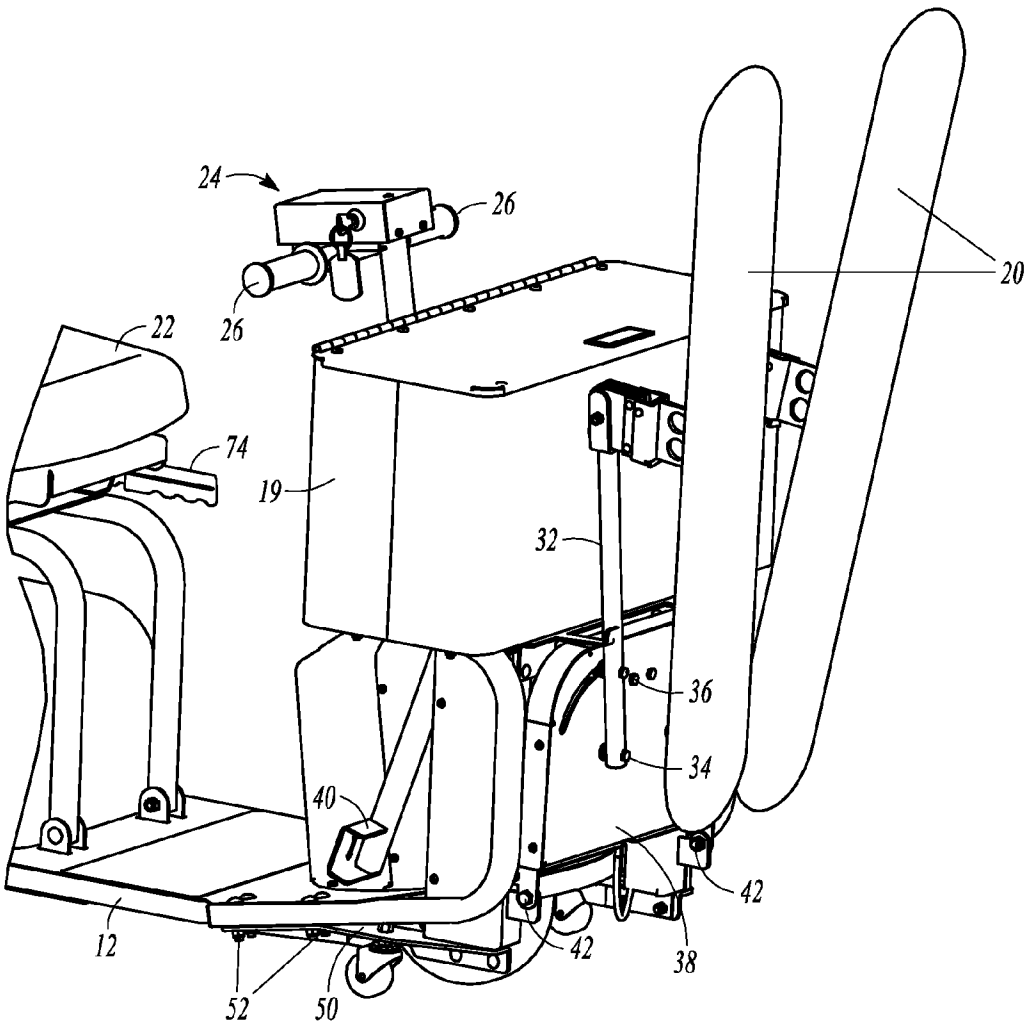

As described above, the one or more cleaning elements 20 can be movable between a deployed or lowered position and an undeployed or raised position. FIGS. 6A, 6B, 7A, and 7B show side views (FIGS. 6A and 6B) and front perspective views (FIGS. 7A and 7B) of the pair of cleaning elements 20 being moved between an undeployed or raised position (FIGS. 6A and 7A) and a deployed or lowered position (FIGS. 6B and 7B). As shown in the figures, the one or more cleaning elements 20 can be pivotably coupled to the cart 12 so that the cleaning elements 20 can be pivoted from being horizontal or substantially horizontal when in the lowered position to vertical or substantially vertical when in the raised position.

The movability of the cleaning elements 20 between the raised position and the lowered position can allow the electric utility vehicle 10 more flexibility during use. For example, a user can store the electric utility vehicle 10 with the cleaning elements 20 in the raised position so that the electric utility vehicle 10 takes up a smaller footprint. Similarly, the cleaning elements 20 can be kept in the raised position when the electric utility vehicle 10 is being transported to or from a cleaning site so that the electric utility vehicle 10 can be more maneuverable. The cleaning elements 20 can then be easily and rapidly deployed by moving the cleaning elements 20 from the raised position to the lowered position.

The electric utility vehicle 10 can include one or more controls 40 to move the one or more cleaning elements 20 from the raised position to the lowered position, and vice versa. The one or more controls 40 can comprise a pedal 40 that can be actuated by a user, such as with the foot of a user sitting on the seat 22. The pedal 40 can move between a first position associated with the raised position of the cleaning elements 20 (FIGS. 6A and 7A), and a second position associated with the lowered position of the cleaning elements 20 (FIGS. 6B and 7B). When a user moves the pedal 40 from the first position to the second position, such as by pulling the pedal 40 back with the user's foot or by pressing on the pedal 40 to engage a release and return mechanism that can move the pedal 40 to the second position. A mechanism can move the cleaning elements 20 from the raised position to the lowered position. When the user is ready to move the cleaning elements 20 back to the raised position, such as when he or she is done cleaning an area with the cleaning elements 20, the user can move the pedal 40 from the second position to the first position, such as by pushing on the pedal 40 with the user's foot.

In an example, the mechanism that moves the cleaning elements 20 between the raised position and the lower position can include one or more mechanical linkages between the pedal 40 and the cleaning elements 20. Each cleaning element 20 can be coupled to a leg 32, and the legs 32 can be pivotally coupled to the cart 12, such as at a pivot point 42, so that the legs 32 can pivot vertically upward and downward. One or more mechanical linkages 44 can connect the pedal 40 to a connection point, such as the connection point 46 on the mounting plate 38 (best seen in FIG. 6B). As the pedal 40 is moved from the first position to the second position, the mechanical linkage 44 can cause the connection point 46 to move forward and vertically downward. The forward and downward movement of the connection point 46 and the pivotal coupling of the mounting plate 38 at the pivot point 42 can cause the mounting plate 38 and the legs 32 to pivot vertically downward and move the cleaning elements 20 from the raised position to the lowered position. Returning the pedal 40 to the first position can cause the mechanical linkage 44 to move the connection point 46 rearward and upward and to pivot the mounting plate 38 and the legs 32 to move the cleaning elements 20 from the lowered position to the raised position.

In an example, the cleaning elements 20 can be manually movable between the raised position and the lowered position. For example, an electric utility vehicle could omit the pedal 40, and a user could manually adjust the cleaning elements 20 to the desired position.

The cleaning elements 20 can be detachably coupled to the wheeled cart 12 so that a user can remove a first set of one or more cleaning elements 20 and replace it with a second set of one or more cleaning elements 20. The second set of cleaning elements 20 can be a replacement set of the same type as the first set of cleaning elements 20, such as to replace damaged or worn out cleaning elements 20. The second set of cleaning elements 20 can also be of a different type of cleaning element than the first set of cleaning elements 20 so that a user can change from one type of cleaning to another. For example, the first set of cleaning elements 20 can be a set of dry mops and the second set of cleaning elements 20 can be one or more wet mops, one or more brooms, one or more brushes, or one or more vacuum assemblies.

Figure 8:
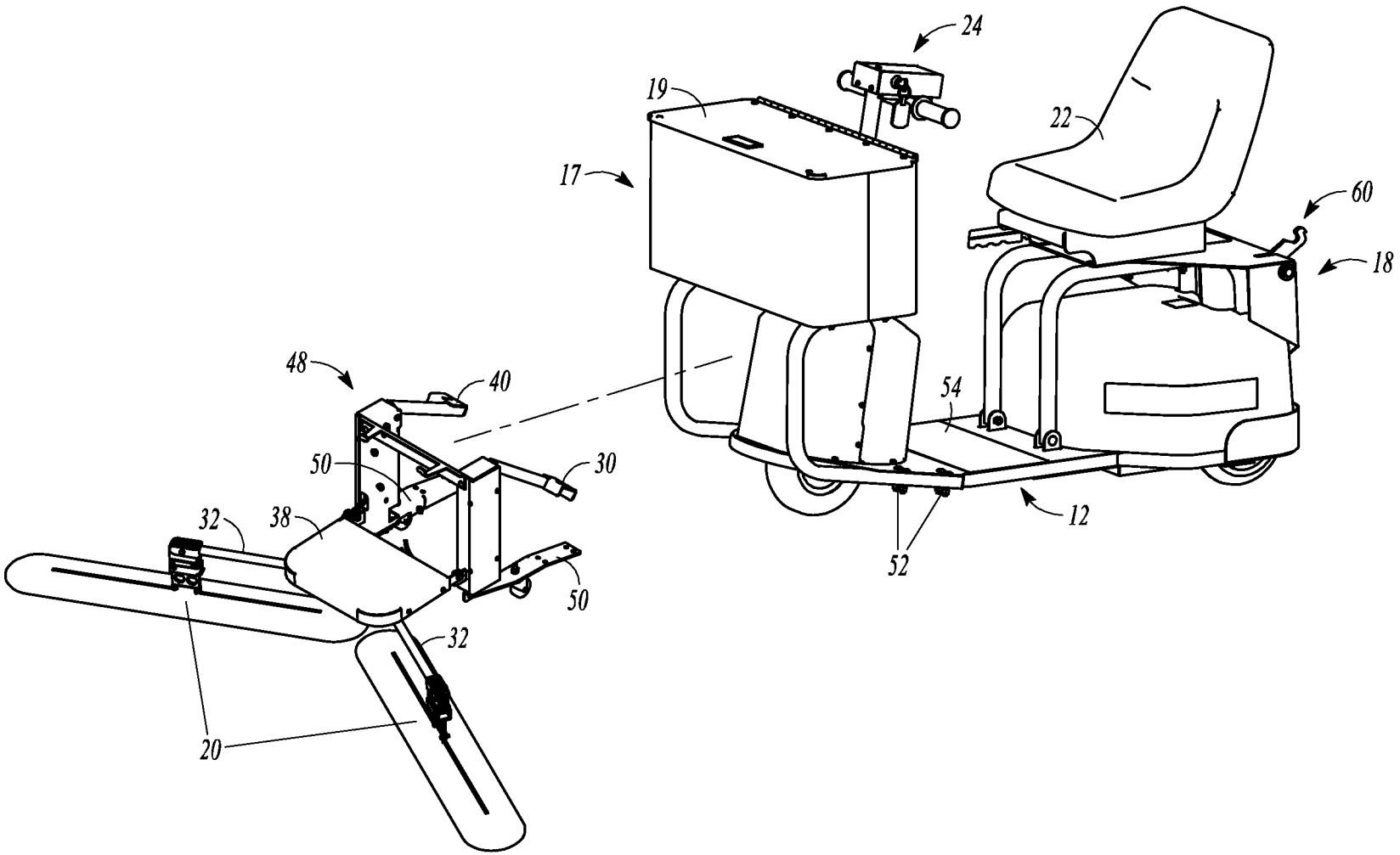
FIG. 8 is a side view of an example electric utility vehicle with an example detachable set of cleaning elements.

FIG. 8 shows a set of cleaning elements 20, such as a set of dry mops, which is detached from the cart 12. The cleaning elements 20 can include one or more coupling structures that can enable coupling between the cart 12 and the set of cleaning elements 20. In an example, the coupling structures can include a coupling frame 48 having one or more arms 50 that can engage with the cart 12. The arms 50 can engage with a corresponding mating structure or structures of the cart 12, such as one or more fasteners 52, to secure the set of cleaning elements 20 to the cart 12. The fasteners 52 can include one or more of screws, bolts, brads, nails, quick-release latches, and the like.

An assembly of dry mops that can be used as the cleaning elements 20 is sold as part number 100-379 by Dane Technologies, Inc., Brooklyn Park, Minn., USA. An assembly of brooms that can be used as the cleaning elements 20 is sold as part number 100-399 by Dane Technologies, Inc. However, other dry mops or brooms can be used. Examples of specific cleaning elements 20 that can be used with the utility vehicle 10 of this disclosure include the dry mops sold as part number 7305T38 by McMaster-Carr Supply Co., Elmhust, Ill., USA, and the brooms sold as part number B20436 by Proline.

As will be appreciated by those of ordinary skill in the art, a vacuum assembly can be coupled to an end of the cart 12, such as the front end 17, in a manner similar to that in which dry mop cleaning elements 20 or broom cleaning elements 20 can be coupled to the cart 12, such as to the front end 17 as shown in FIGS. 1-3, or a vacuum assembly can be coupled to the cart 12 on a bottom, a side, or a rear of the cart 12 so that the vacuum assembly can be mounted separate from dry mops, mops, brooms, brushes, and other cleaning elements. In an example, one or more components of a vacuum assembly, such as a vacuum motor, a vacuum fan, vacuum brushes, and the like, can be mounted to a base 54 of the cart 12.

The electric utility vehicle 10 can also include means or structures for mounting or coupling a second platform to the cart 12. In an example, the wheeled cart 12 can include a mounting structure 60 at a location of the cart 12 that is different from the location where the one or more cleaning elements 20 are coupled to the cart 12. For example, the one or more cleaning elements 20 can be coupled to a first location of the cart 12, such as at the front end 17, while the mounting structure 60 can be located at a second location of the cart 12, such as at the rear end 18.

Figure 9A:
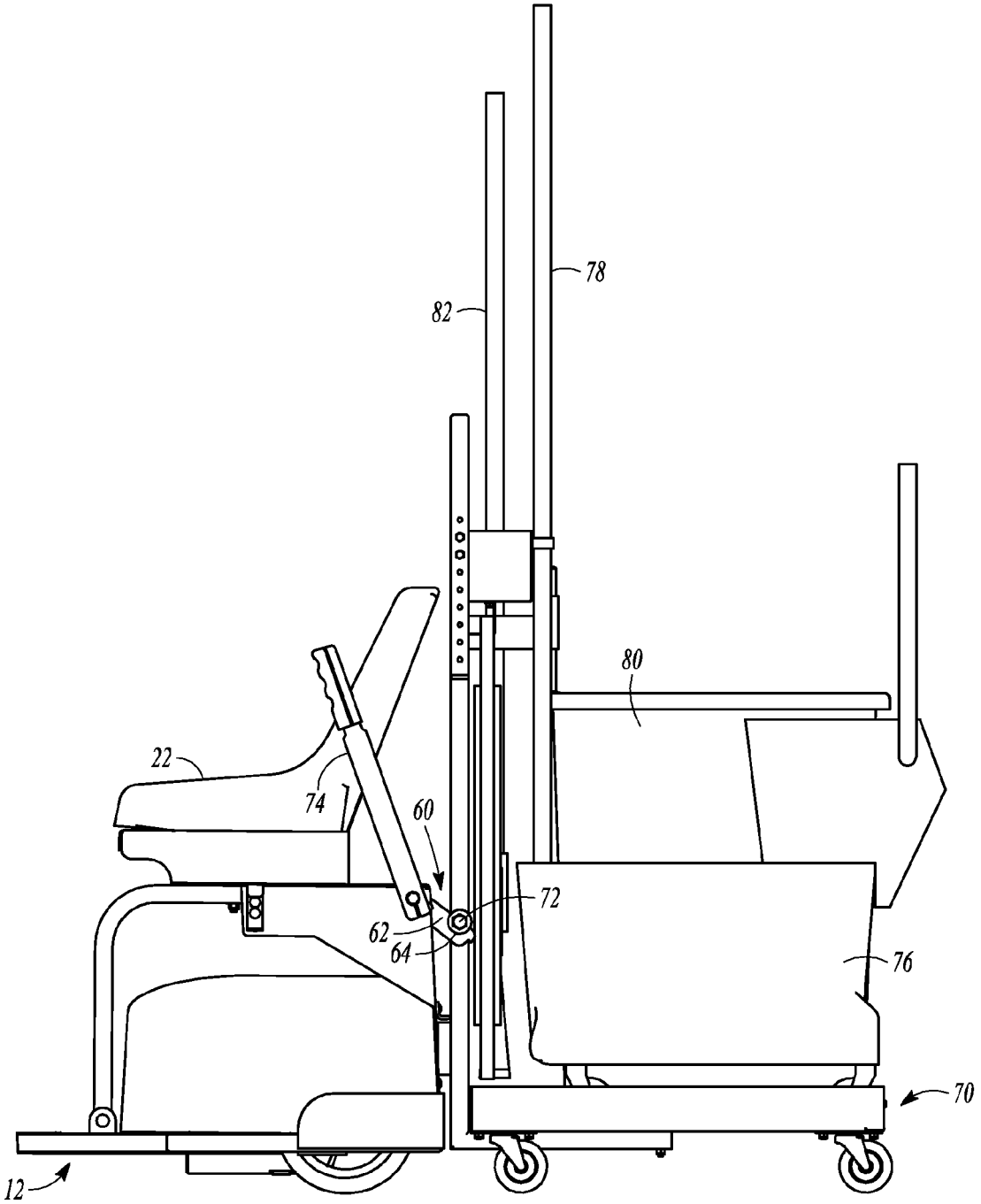
FIGS. 9A and 9B are side views of a janitorial cart coupled to a back side of the electric utility vehicle.
Figure 9B:
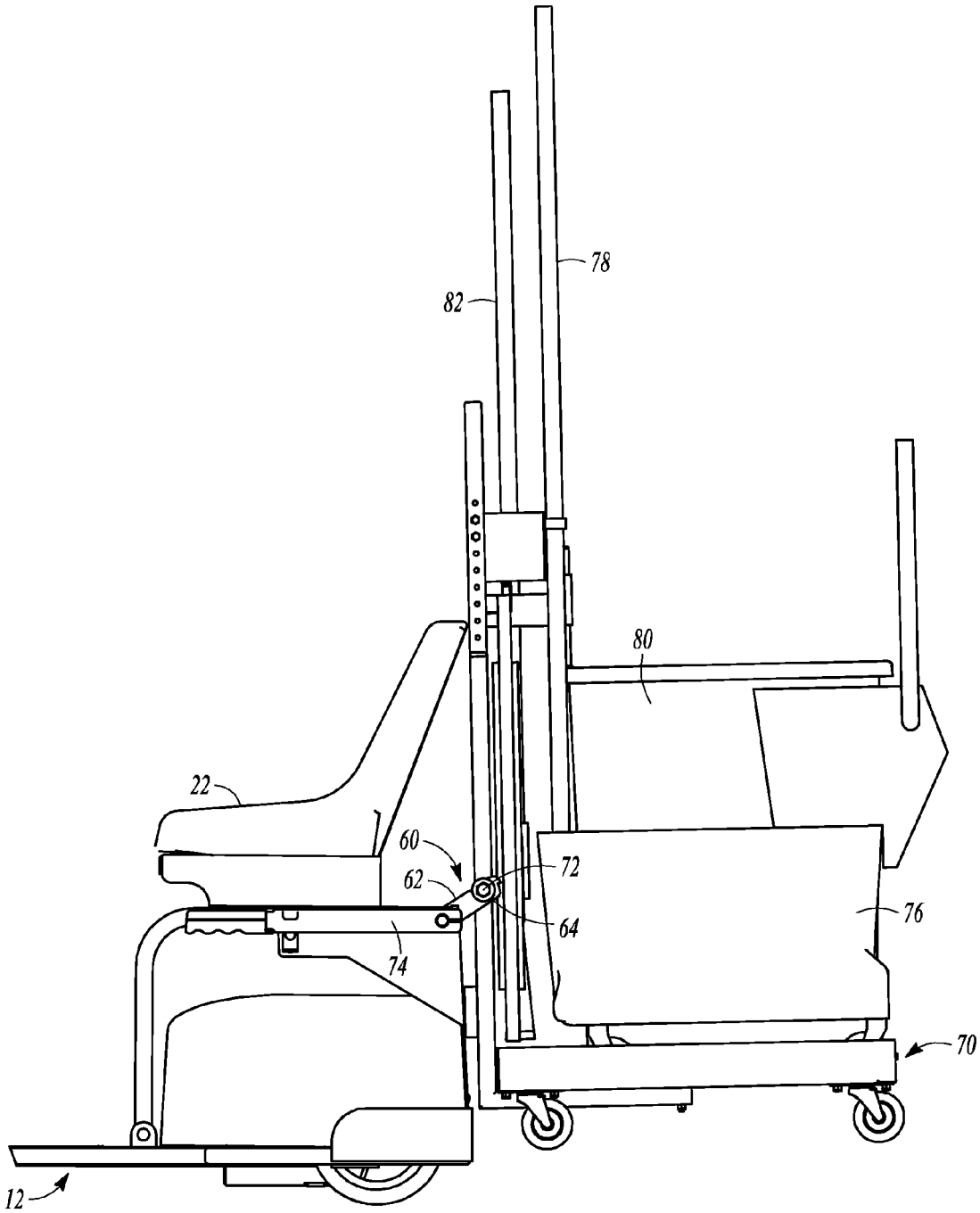

As shown in FIGS. 1, 9A, and 9B, the mounting structure 60 can include one or more hooks 62 that can engage a second platform 70. The second platform 70 can be another wheeled cart, such as a janitorial cart 70 that can be configured to carry one or more combinations of objects that can be useful to a user. As shown in FIG. 9B, the mounting structure 60 can hold the janitorial cart 70 in an elevated position relative to the cart 12 so that when the janitorial cart 70 is coupled with the mounting structure 60, the janitorial cart 70 can be lifted off the ground.

In an example shown in FIGS. 9A and 9B, the mounting structure 60 can be raised and lowered so that the janitorial cart 70 can be coupled with the mounting structure 60 without the user having to lift the janitorial cart 70 off the ground. FIG. 9A shows the mounting structure 60 in a lowered position so that the hooks 62 are in a position to receive the janitorial cart 70. The janitorial cart 70 can be rolled into position so that a bar 72 or other mating structure on the janitorial cart 70 can be in position to be engaged by the hooks 62, such as in one or more mating grooves 64 in each hook 62. The janitorial cart 70 can be secured to the mounting structure 60, such as with clamps or other securing means, so that the janitorial cart 70 can be securely fastened as the mounting structure 60 moves to the raised position. A user can then move the mounting structure 60 to a raised position in order to lift the janitorial cart 70 upward, as shown in FIG. 9B. In an example, a lever 74 can be linked to the mounting structure 60 in order to move the mounting structure 60 to the raised position. In the example shown in FIGS. 9A and 9B, the lever 74 is coupled to the hooks 62 in a fixed manner so that the hooks 62 pivot as the lever 74 is pivoted by a user. As the lever 74 and hooks 62 pivot, the hooks 62 can lift the janitorial cart 70.

Figure 10:
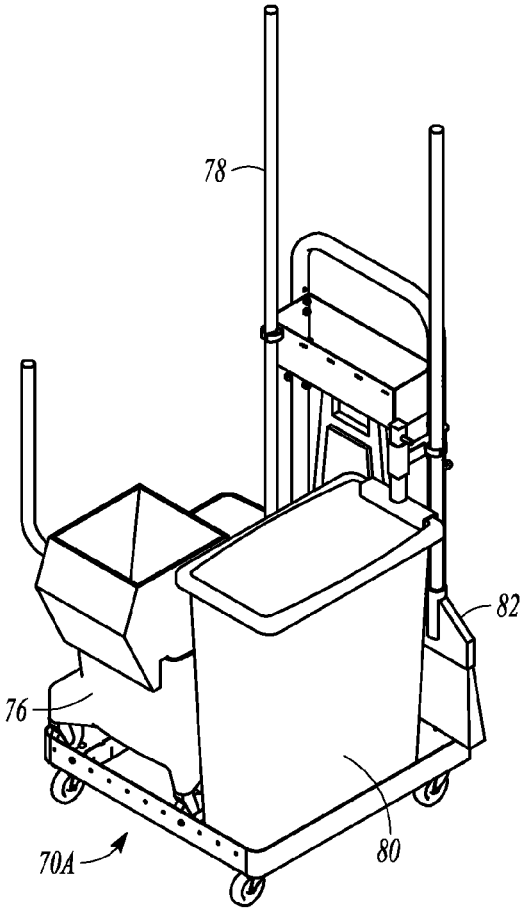
FIG. 10 is a perspective view showing the example janitorial cart holding a mop bucket and a trash receptacle.
Figure 11:
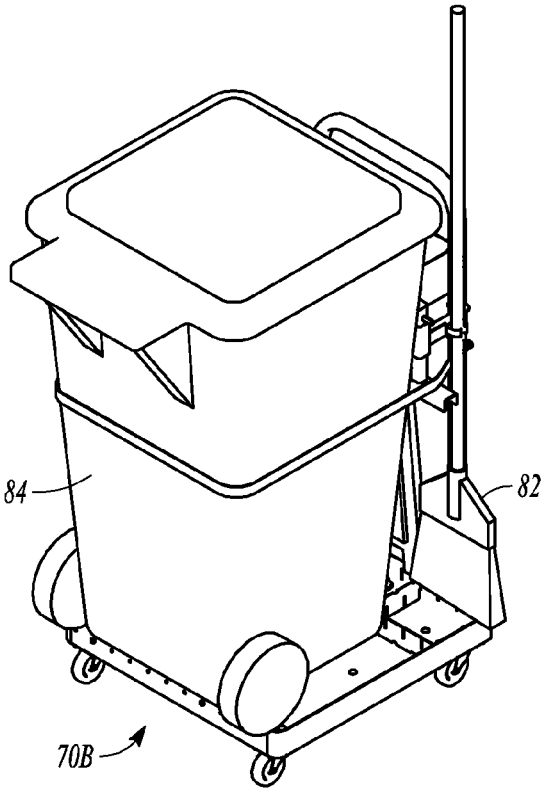
FIG. 11 is a perspective view showing the example janitorial cart holding a large trash receptacle.

The janitorial cart 70 can be a general purpose cart that can carry one or more objects that can be useful for a user of the utility vehicle 10. For example, as shown in FIG. 10, an example of a janitorial cart 70A can include a first location for holding or securing a mop bucket 76 and a mop 78 and a second location for holding or securing a receptacle 80, such as a trash receptacle, a paper-products receptacle, or a cleaning-supplies receptacle. The janitorial cart 70 can also be configured to hold other cleaning implements, such as a broom 82. FIG. 11 shows another example of a janitorial cart 70B that can hold a large receptacle, such as a large trash receptacle 84. Other configurations of the janitorial cart 70 can be envisioned by a person of ordinary skill in the art.

Figure 12A:
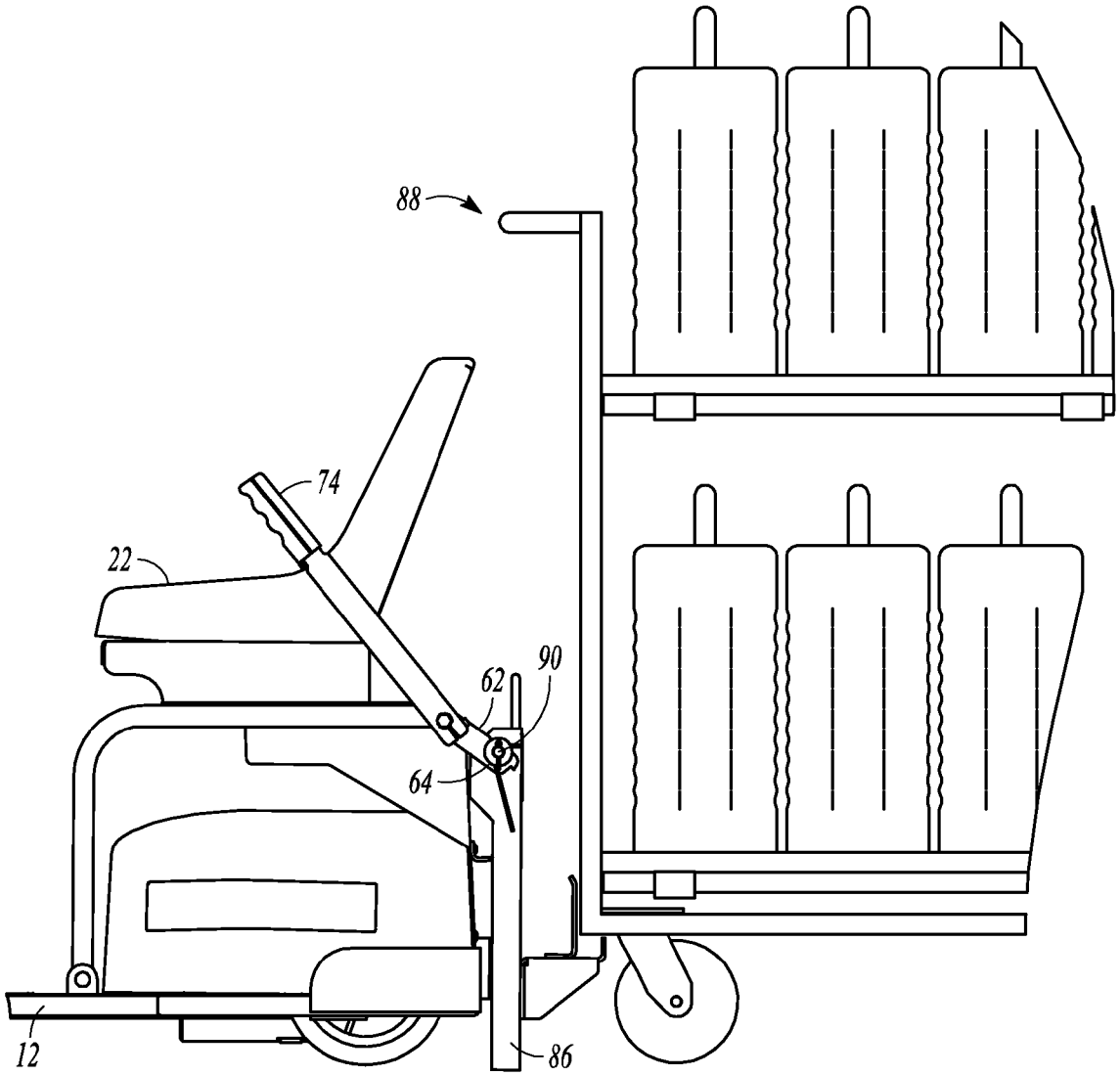
FIGS. 12A and 12B are side views of an example supplementary cart coupled to the electric utility vehicle.
Figure 12B:
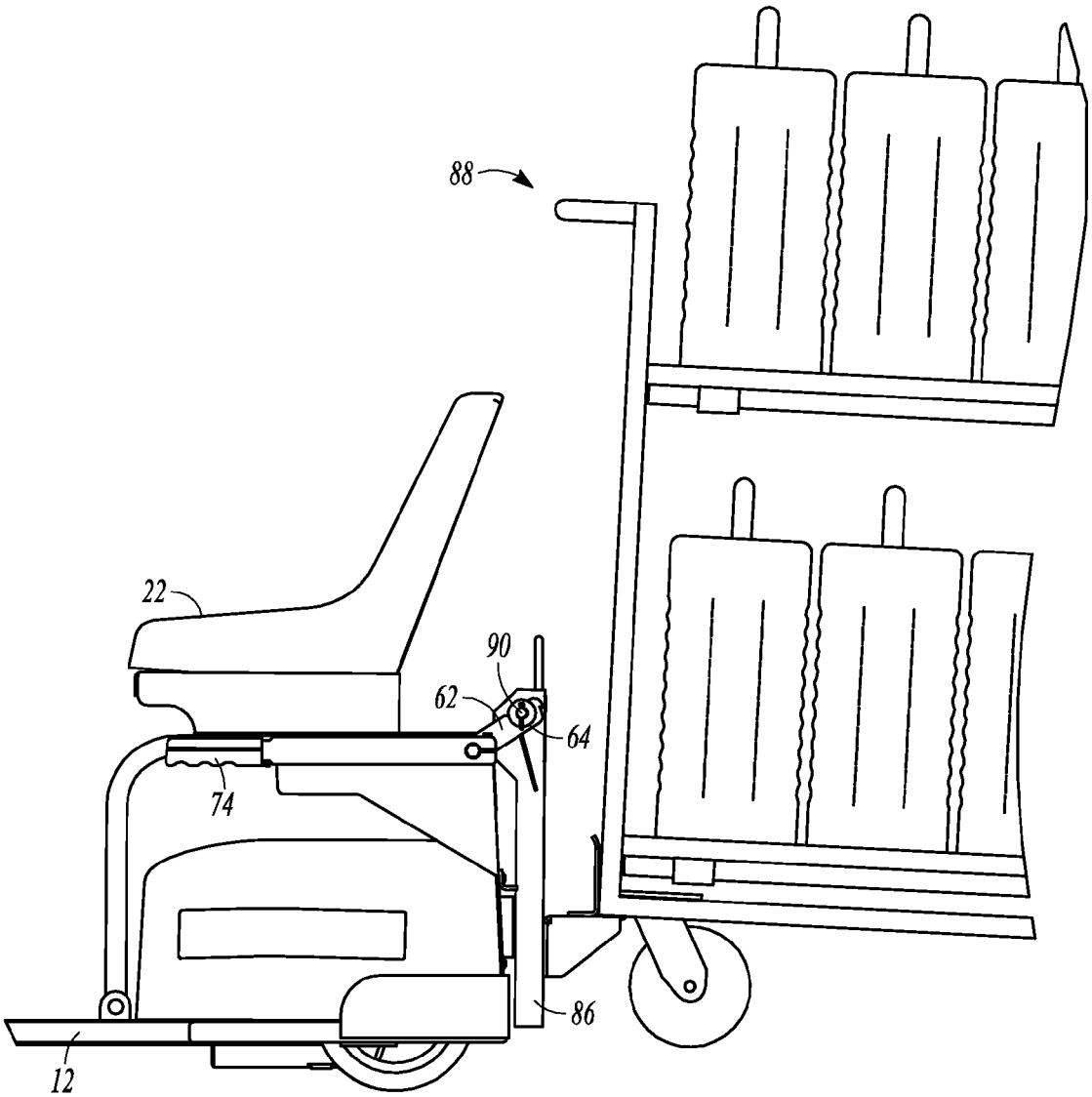

In another example, an electric utility vehicle 10 can be configured to tow a second platform behind the cart 12. FIGS. 12A and 12B show an example cart 12 that includes a hitch 86 located on the back end 18 of the cart 12. The hitch 86 can be configured to couple to a wheeled supplementary cart 88 that can be towed behind the main cart 12. The supplementary cart 88 can be used to transport large supplies, such as cleaning supplies or paper products. The hitch 86 can be configured to be raised or lowered. In an example, the hitch 86 can be coupled the mounting structure 60 so that the lever 74 can be used to move the hitch 64 from a lowered position, as in FIG. 12A, to a raised position, as in FIG. 12B. As shown in FIGS. 12A and 12B, the hitch 86 can include a bar 90 that can be engaged in the grooves 64 of the hooks 62 so that the hitch 86 be lifted by the hooks 62, which in turn are moved by the lever 74, as described above. As a user pivots the lever 74, the hooks 62 can lift the hitch 86, which can lift the supplementary cart 88.

Figure 13:
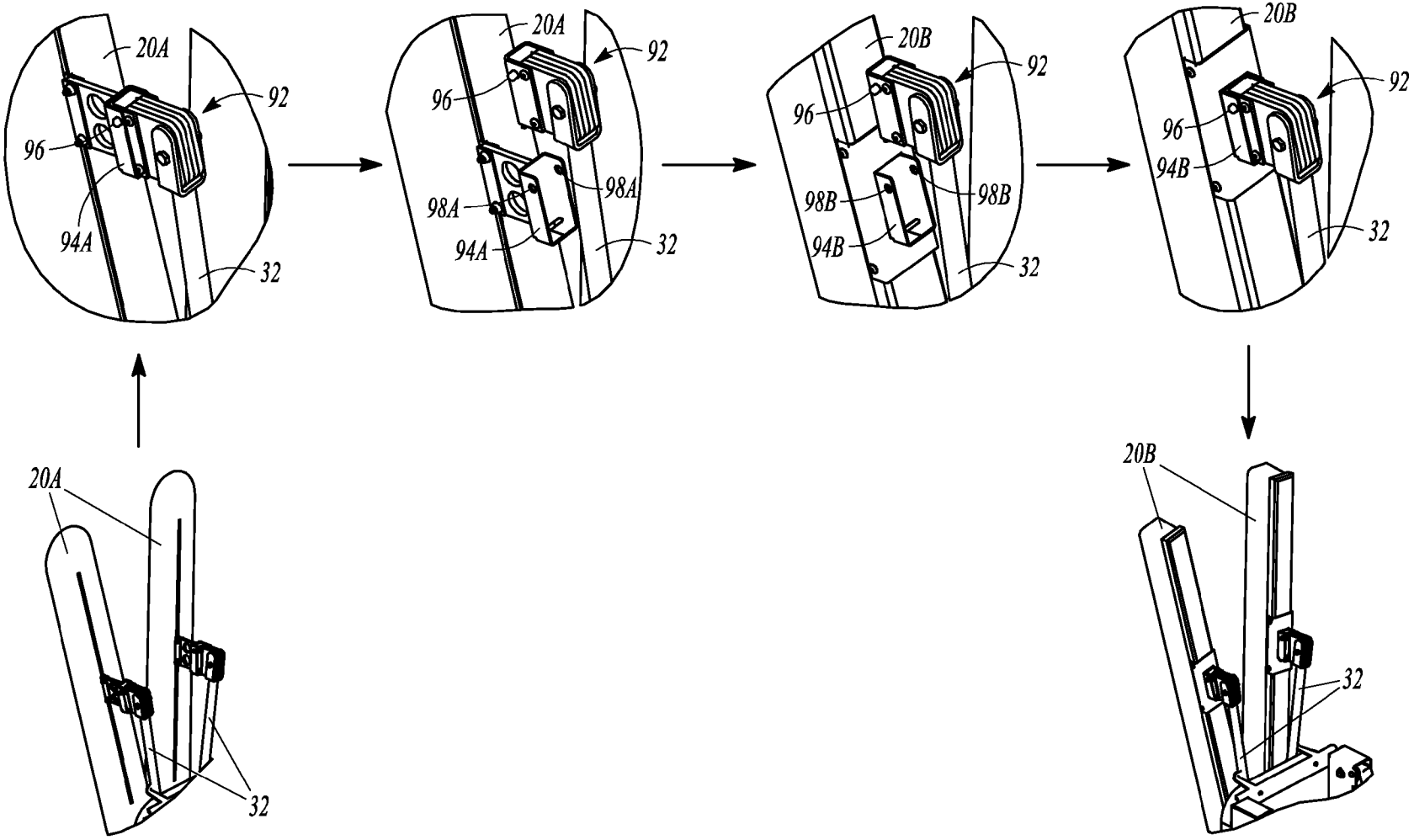
FIG. 13 is a series of perspective views showing the removal of a first set of cleaning elements and the mounting of a second set of cleaning elements.

FIG. 13 shows an example process of removing a first set of one or more cleaning elements 20A and replacing them with a second set of one or more cleaning elements 20B. In the example shown in FIG. 13, the first set of cleaning elements 20A comprises a set of dry mops 20A and the second set of cleaning elements 20B comprises a set of brooms 20B. As shown, each cleaning element 20A, 20B can be coupled to an arm 32, which in turn can be coupled to the wheeled cart 12, as described above. A bracket 92 can be located at a distal end of each arm 32, wherein the bracket 92 can be configured to couple with a mating bracket 94A, 94B of a corresponding cleaning element 20A, 20B. The bracket 92 can include one or more fastening structures for securing to the mating bracket 94A, 94B. In an example, the fastening structure can include one or more spring-loaded detents 96 that can be received by a structure in the mating bracket 94A, 94B, such as an opening 98A, 98B in the mating bracket 94A, 94B.

In the example process shown in FIG. 13, each dry mop 20A can be removed from a corresponding arm 32 by depressing the detents 96 to remove them from the openings 98A and moving the bracket 92 out of engagement with the mating bracket 94A of the dry mop 20A. Each broom 20B can be coupled with a corresponding arm 32 by positioning the mating bracket 94B relative to the bracket 92 and moving the bracket 92 into the mating bracket 94B until the detents 96 engage the openings 98B.

The above Detailed Description is intended to be illustrative, and not restrictive. For example, the above-described examples (or one or more elements thereof) can be used in combination with each other. Other embodiments can be used, such as by one of ordinary skill in the art upon reviewing the above description. Also, various features or elements can be grouped together to streamline the disclosure. This should not be interpreted as intending that an unclaimed disclosed feature is essential to any claim. Rather, inventive subject matter can lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented, at least in part. Some examples can include a computer-readable medium or machine-readable medium encoded with instructions operable to configure an electronic device to perform methods or method steps as described in the above examples. An implementation of such methods or method steps can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The Abstract is provided to comply with 37 C.F.R. §1.72 (b), to allow the reader to quickly ascertain the nature of the technical disclosure. It is submitted with the understanding that it will not be used to interpret or limit the scope or meaning of the claims.

What is claimed is:

1. An electric utility vehicle comprising:

a wheeled platform;

a seat coupled to the platform for carrying a user;

an electric motor coupled to the platform and configured to propel the platform;

a pair of cleaning elements coupled to the platform, wherein the pair of cleaning elements is movable between a raised position and a lowered position, wherein the pair of cleaning elements is movable between a collapsed position and an expanded position with respect to each other;

a first control configured to move the pair of cleaning elements between the raised position and the lowered position, wherein the first control is configured to move between a first position corresponding to the raised position of the pair of cleaning elements and a second position corresponding to the lowered position of the pair of cleaning elements, further comprising a mechanical linkage between the first control and the pair of cleaning elements, the mechanical linkage comprising:

a pair of legs each coupled to a corresponding one of the pair of cleaning elements;

a mounting plate coupled to the pair of legs, the mounting plate including a pivot point pivotally coupled to the wheeled platform and a connection point;

wherein the connection point is mechanically coupled to the first control so that mounting plate and the pair of cleaning elements are pivoted vertically downward when the first control is moved to the second position and so that the mounting plate and the pair of cleaning elements are pivoted vertically upward when the first control is moved to the first position; and a second control configured to move the pair of cleaning elements between the collapsed position and the expanded position.

2. The electric utility vehicle of claim 1, wherein when in the collapsed position, a width of the at least one cleaning element is narrower than a width of the platform.

3. The electric utility vehicle of claim 1, further comprising a second platform configured to be removably coupled to the wheeled platform, wherein the second platform is configured to carry at least one of a trash receptacle, a mop bucket, a paper-product receptacle, or a cleaning-supplies receptacle.

4. The electric utility vehicle of claim 1, wherein the pair of cleaning elements is movable between a vertical or substantially vertical raised position and a lowered position.

5. The electric utility vehicle of claim 1, further comprising a wheeled cart configured to be removably coupled to the wheeled platform.

6. The electric utility vehicle of claim 1, wherein the pair of cleaning elements is detachable from the wheeled platform, the electric utility vehicle further comprising a second pair of cleaning elements coupleable to the wheeled platform when the at least one first cleaning element is detached.

7. The electric utility vehicle of claim 6, wherein the first pair of cleaning elements comprises one of a pair of mops or a pair of brooms and the second pair of cleaning elements comprises the other of the pair of mops or the pair of brooms.

8. An electric utility vehicle comprising:

a wheeled platform;

a seat coupled to the platform for carrying a user;

an electric motor coupled to the platform and configured to propel the platform;

a pair of cleaning elements coupled to the platform, wherein the pair of cleaning elements is movable between a raised position and a lowered position, wherein the pair of cleaning elements is movable between a collapsed position and an expanded position with respect to each other;

a first control configured to move the pair of cleaning elements between the raised position and the lowered position; and a second control configured to move the pair of cleaning elements between the collapsed position and the expanded position;

wherein the second control is configured to move between a first position corresponding to the collapsed position of the pair of cleaning elements and a second position corresponding to the expanded position of the pair of cleaning elements, further comprising a mechanical linkage between the second control and the at least one cleaning element, the mechanical linkage comprising:

a pair of legs, each coupled to a corresponding one of the pair of cleaning elements, each leg including a pivot point coupled to the platform and a connection point, wherein the connection point of each of the pair of legs is mechanically coupled to the second control so that the pair of cleaning elements are pivoted laterally outward when the second control is moved to the second position and so that the pair of cleaning elements are pivoted laterally inward when the second control is moved to the first position.

9. The electric utility vehicle of claim 8, further comprising a second platform configured to be removably coupled to the wheeled platform, wherein the second platform is configured to carry at least one of a trash receptacle, a mop bucket, a paper-product receptacle, or a cleaning-supplies receptacle.

10. The electric utility vehicle of claim 8, wherein the pair of cleaning elements is detachable from the wheeled platform.

11. The electric utility vehicle of claim 10, further comprising at least one second pair of cleaning element coupleable to the wheeled platform when the pair of cleaning elements is detached.

12. The electric utility vehicle of claim 11, wherein the first pair of cleaning elements comprises one of a pair of mops or a pair of brooms and the second pair of cleaning elements comprises the other of the pair of mops or the pair of brooms.

* * * * *